US007926185B2

(12) United States Patent
Sugawara

(10) Patent No.: US 7,926,185 B2
(45) Date of Patent: Apr. 19, 2011

(54) SCISSORS WITH COMB

(75) Inventor: Akira Sugawara, Seki (JP)

(73) Assignee: Kai R&D Center Co., Ltd., Gifu-ken (JP)

( * ) Notice: Subject to any disclaimer, the term of this patent is extended or adjusted under 35 U.S.C. 154(b) by 545 days.

(21) Appl. No.: 12/071,720

(22) Filed: Feb. 26, 2008

(65) Prior Publication Data

US 2008/0201962 A1 Aug. 28, 2008

(30) Foreign Application Priority Data

Feb. 28, 2007 (JP) ..... 2007-049954

(51) Int. Cl.
*B26B 13/24* (2006.01)

(52) U.S. Cl. ..... 30/233.5; 30/30; 30/195; 30/257

(58) Field of Classification Search ..... 30/30, 31, 30/53, 233.5, 257, 195; 132/213.1; D8/57
See application file for complete search history.

(56) References Cited

U.S. PATENT DOCUMENTS

| | | | | | |
|---|---|---|---|---|---|
| 84,860 | A * | 12/1868 | Craig | 30/233.5 |
| 434,145 | A * | 8/1890 | Gamble | 30/233.5 |
| 628,722 | A * | 7/1899 | McCarter | 30/233.5 |
| 1,004,404 | A * | 9/1911 | Fordyce | 30/233.5 |
| 1,440,015 | A * | 12/1922 | Kaniefski | 132/148 |
| 1,466,193 | A * | 8/1923 | Schuster | 30/131 |
| 1,639,617 | A * | 8/1927 | Seavey | 30/233.5 |
| 2,328,975 | A * | 9/1943 | Hammond | 30/233.5 |
| 2,677,179 | A * | 5/1954 | Servilla | 30/256 |
| 5,153,997 | A * | 10/1992 | Chiavaras et al. | 30/257 |
| 5,259,114 | A * | 11/1993 | Shorter | 30/131 |
| 6,079,107 | A * | 6/2000 | Horvath | 30/233.5 |
| 6,526,663 | B1 * | 3/2003 | Simmons et al. | 30/233.5 |
| 2009/0032043 | A1 * | 2/2009 | Gaugler | 132/148 |
| 2009/0044411 | A1 * | 2/2009 | Cotant | 30/233.5 |

FOREIGN PATENT DOCUMENTS

| | | |
|---|---|---|
| JP | U52-38376 | 8/1977 |
| JP | U2-109563 | 9/1990 |
| JP | U3-49764 | 5/1991 |
| JP | U4-36966 | 3/1992 |
| JP | U4-112373 | 9/1992 |
| JP | U6-7666 | 2/1994 |
| JP | U8-277 | 2/1996 |
| JP | U2523648 | 10/1996 |
| JP | P2902296 | 3/1999 |
| JP | U3065324 | 10/1999 |
| JP | P2004-159962 | 6/2004 |

* cited by examiner

*Primary Examiner* — Hwei-Siu C Payer
(74) *Attorney, Agent, or Firm* — Posz Law Group, PLC

(57) ABSTRACT

A pair of scissors with comb comprises a first blade having an edge, a second blade openably and closably supported together with the first blade and having an edge and a comb member attached to the first blade. The comb member is provided with a plurality of comb tooth groups with different characteristics from each other. The comb member is attached to and detached from the first blade. The mounting state of each comb tooth group is changed with respect to the first blade, whereby, for example, an extending direction of the comb tooth group is changed based on differences in the direction of eyebrows so that each comb tooth group can be used properly. Since an extending direction of a comb tooth of each comb tooth group inclines, the scissors with comb can be rendered convenient when eyebrows are trimmed.

8 Claims, 10 Drawing Sheets

SCISSORS WITH COMB

BACKGROUND OF THE INVENTION

This invention relates to a pair of scissors with comb used, for example, in trimming eyebrows.

Japanese Laid-Open Patent Publication No. 2004-159962 discloses a pair of scissors with comb detachably attached to one of the blades. The comb is provided with one group of comb teeth, each of which extends in the direction orthogonal to an extending direction of an edge of the blade. Therefore, the comb teeth cannot be used properly according to differences in characteristics such as the direction of eyebrows and differences between the left eyebrow hair and the right eyebrow hair.

SUMMARY OF THE INVENTION

Accordingly, an objective of the present invention is to provide a pair of scissors with comb, configured such that when eyebrows are trimmed, for example, comb teeth can be used properly in accordance with differences in characteristics such as the direction of eyebrows and differences between the left eyebrow and right eyebrow thereupon providing ease of use.

To achieve the foregoing objective and in accordance with a first aspect of the present invention, a pair of scissors with comb having a first blade having an edge, a second blade openably and closably supported together with the first blade and having an edge, and a comb member detachably attached to the first blade is provided. The comb member has a plurality of comb tooth groups with different characteristics from each other.

In accordance with a second aspect of the present invention, a pair of scissors with comb having a first blade having an edge, a second blade openably and closably supported together with the first blade and having an edge, a comb member detachably attached to the first blade and having a plurality of comb tooth groups, and a mounting portion provided in at least one of the first blade and the comb member is provided. The mounting portion mounts the comb member to the first blade, and aligns a specific comb tooth group of the plurality of comb tooth groups with the edge of the first blade. The positions of the comb tooth groups with respect to the first blade are changeable.

In accordance with a third aspect of the present invention, a pair of scissors with comb having a first blade having an edge, a second blade openably and closably supported together with the first blade and having an edge, and a comb member detachably attached to the first blade and having a comb tooth group is provided. The edge of the first blade and the comb tooth group of the comb member are aligned. The edge of the first blade and the edge of the second blade slidably contact each other when the blades are closed. An extending direction of a comb tooth of the comb tooth group inclines with respect to an extending direction of the edge of the first blade.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
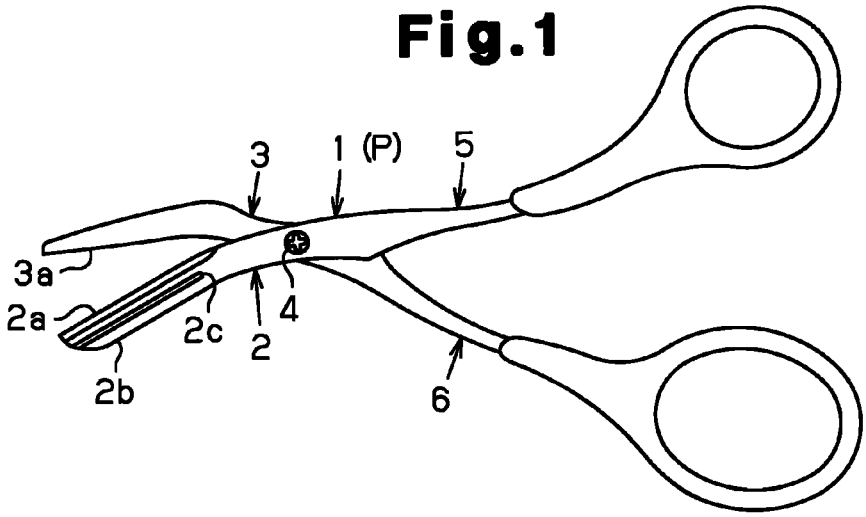
FIG. 1 is a front view showing a scissors body in an open state in accordance with one embodiment of the present invention.
Figure 2A:
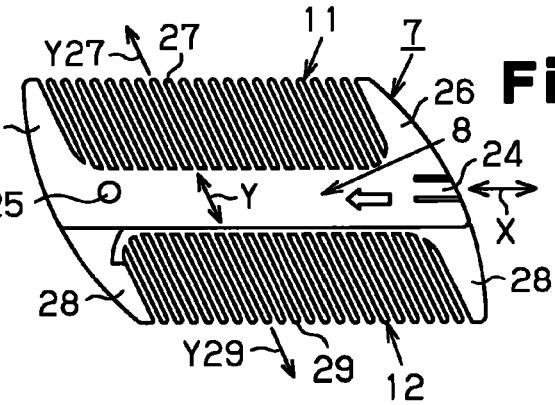
FIG. 2A is a front view showing a comb member.
Figure 2D:
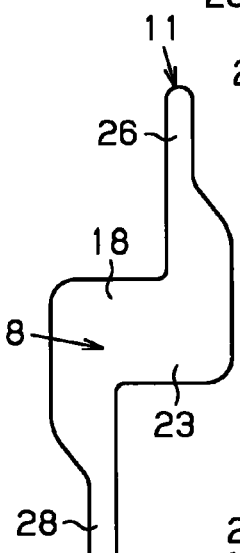
FIG. 2D is a left side view showing the comb member.
Figure 2C:
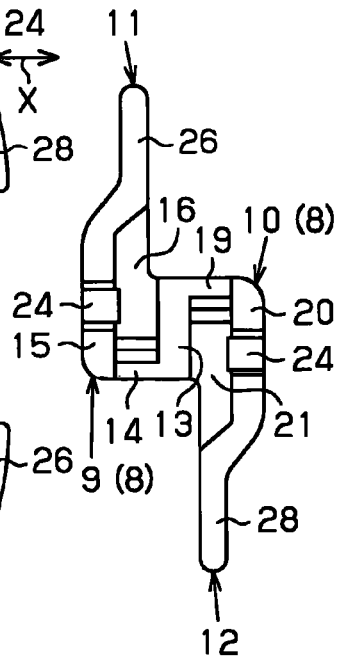
FIG. 2C is a right side view showing the comb member.
Figure 2B:
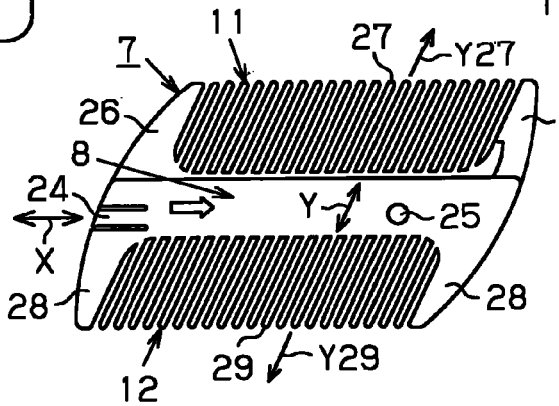
FIG. 2B is a back view showing the comb member.

Hereinafter, the present invention is embodied into a pair of scissors with comb, and its embodiments are described based on the drawings. As shown in FIG. 1, a scissors body 1 of a pair of scissors with comb in accordance with a first embodiment includes a first blade 2, a second blade 3 supported openably and closably together with the first blade 2, an opening/closing pivot 4 of the blades 2 and 3, a first handle 5 extending from the first blade 2 and a second handle 6 extending from the second blade 3. The blades 2, 3 are provided on distal ends of the scissors body 1. The handles 5, 6 are provided on proximal ends of the scissors body 1. The blades 2, 3 and the handles 5, 6 are arranged pivotably around the opening/closing pivot 4 between an open state P shown in FIG. 1 and a closed state Q shown in FIGS. 3A and 6A. An edge 2*a* of the first blade 2 and an edge 3*a* of the second blade 3 are separated from each other in the open state P. As the edges 2*a* and 3*a* are engaged with each other, an inner surface of the first blade 2 and an inner surface of the second blade 3 slidably contact each other in the closed state Q. An engaging groove 2*c* is formed along the edge 2*a* between the edge 2*a* and a back 2*b* on an outer surface of the first blade 2.

As shown in FIGS. 2A to 3A and 6A, a comb member 7 for the pair of scissors with comb is integrally molded of plastic. The comb member 7 includes a mounting portion group 8 having a pair of insertion grooves 9 and 10 as a mounting portion and a pair of comb tooth groups 11 and 12 arranged on both sides of the mounting portion group 8. The comb member 7 may be integrally molded of materials other than plastic.

Figure 4A:
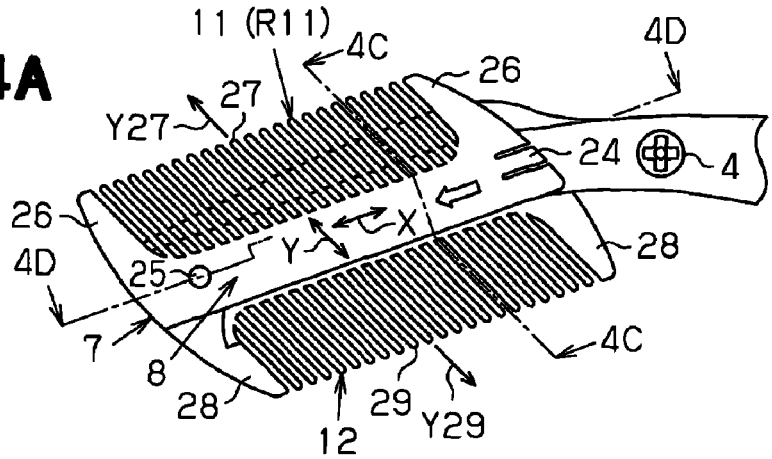
FIG. 4A is a front view showing, in an enlarged manner, the state where the scissors body in a closed state is attached to the insertion groove.
Figure 4B:
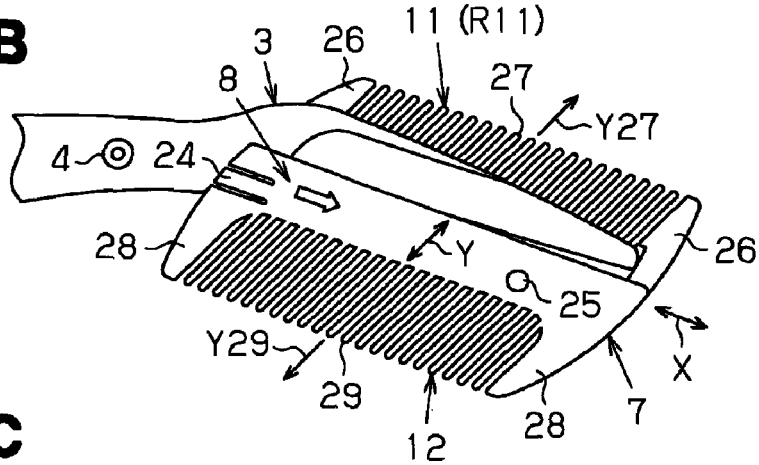
FIG. 4B is a back view showing, in an enlarged manner, the state where the scissors s body in a closed state is attached to the insertion groove.
Figure 4C:
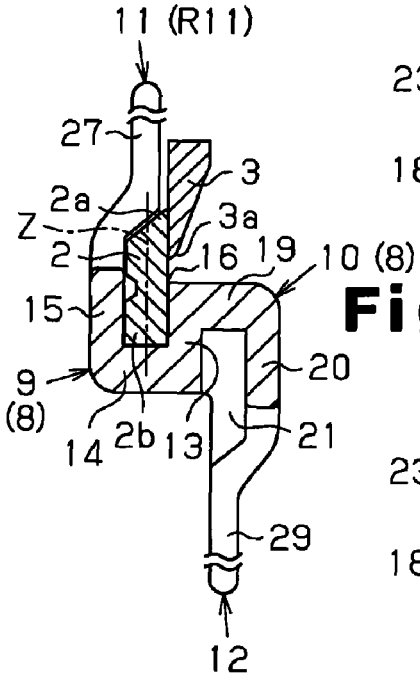
FIG. 4C is an enlarged cross-sectional view taken along line 4C-4C in FIG. 4A.
Figure 7A:
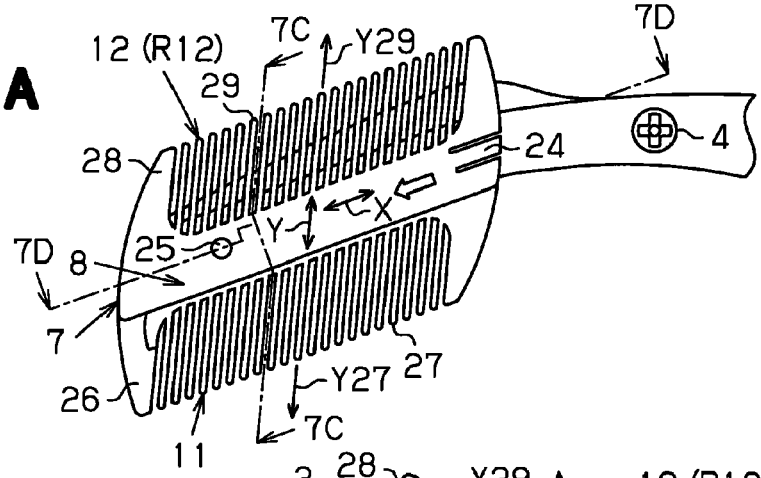
FIG. 7A is a front view showing, in an enlarged manner, the state where the scissors body in a closed state is attached to the insertion groove.
Figure 7B:
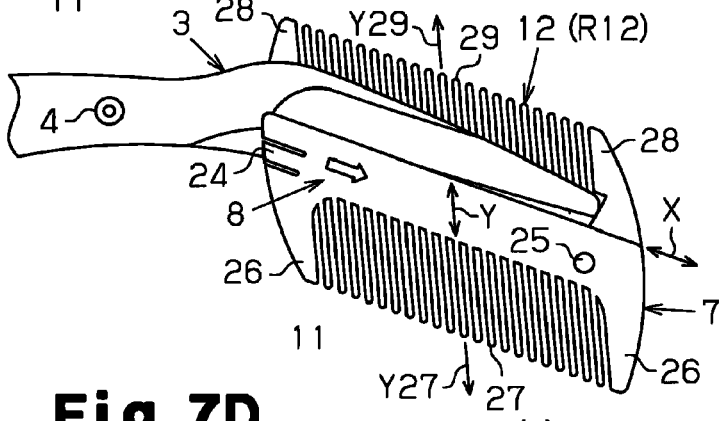
FIG. 7B is a back view showing, in an enlarged manner, the state where the scissors body in a closed state is attached to the insertion groove.
Figure 7C:
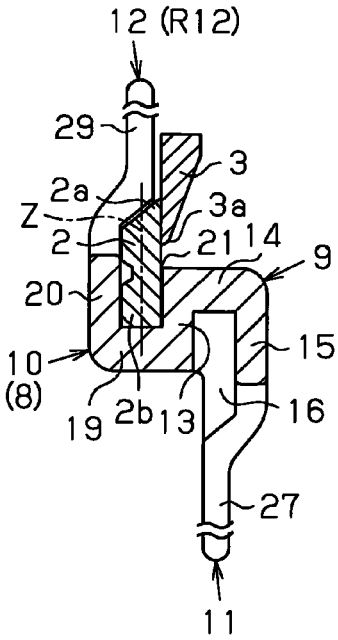
FIG. 7C is an enlarged cross-sectional view taken along line 7C-7C in FIG. 7A.

In a first insertion groove 9 of the two insertion grooves 9 and 10 in the mounting portion group 8, a bottom wall 14 extends from a first end of both ends of a common inner side wall 13 of the insertion grooves 9 and 10, as shown in FIGS. 4C and 7C. An outer side wall 15 extends from the bottom wall 14 opposing the inner side wall 13. An opening 16 is formed between the side walls 13 and 15. In a second insertion groove 10 of the two insertion grooves 9 and 10, a bottom wall 19 extends from a second end of both ends of the common inner side wall 13 of the insertion grooves 9 and 10. An outer side wall 20 extends from the bottom wall 19 opposing the inner side wall 13. An opening 21 is formed between the side walls 13 and 20. When the first blade 2 is inserted into the first insertion groove 9, for example, a central plane Z between an inner surface and an outer surface joining the edge 2*a* and back 2*b* of the first blade 2 extends along each comb tooth 27, as shown in FIG. 4C.

Figure 4D:
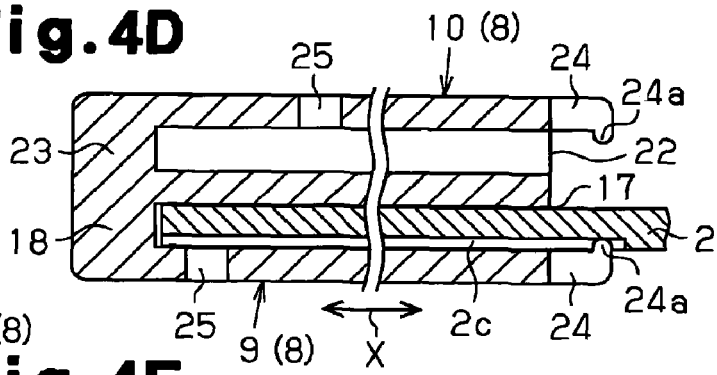
FIG. 4D is an enlarged cross-sectional view taken along line 4D-4D in FIG. 4A.
Figure 7D:
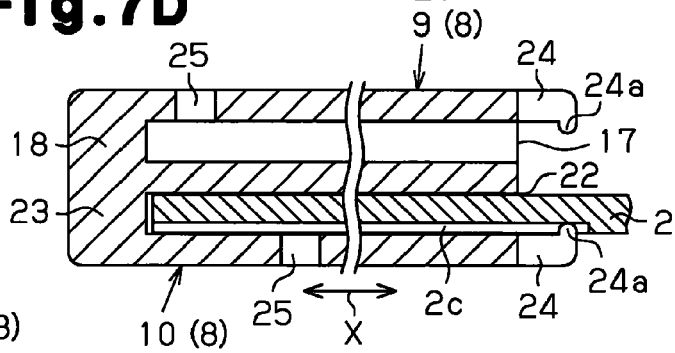
FIG. 7D is an enlarged cross-sectional view taken along line 7D-7D in FIG. 7A.

The insertion grooves 9 and 10 are arranged point-symmetrically in a circumferential direction about their extending direction X. As shown in FIG. 4D and FIG. 7D, one of both sides of the comb member 7 in the extending direction X is formed with inserting and removing ports 17 and 22 respectively. The other side of the comb member 7 is formed with closed walls 18 and 23 respectively. The ports 17 and 22 are adjacent to each other in the circumferential direction about the extending direction X. The closed walls 18 and 23 are also adjacent to each other in the circumferential direction about the extending direction X. More specifically, the ports 17 and 22 are adjacent to each other in the direction orthogonal to the extending direction X. The closed walls 18 and 23 are also adjacent to each other in the direction orthogonal to the extending direction X. A part in each outer side wall 15, 20 that faces the inserting and removing port 17, 22 is formed with an elastic cantilevered engaging tongue 24. Each engaging tongue 24 is formed with a protrusion 24*a* extending inwardly. On the side of each closed wall 18, 23, each outer side wall 15, 20 is formed with a molding through-hole 25 communicating with the interior of the insertion groove 9, 10.

On the outer side wall 15 of the first insertion groove 9, side frames 26 are provided projectingly at places opposing the port 17 and the closed wall 18. A plurality of comb teeth 27 are provided projectingly between the side frames 26. On the outer side wall 20 of the second insertion groove 10, side frames 28 are provided projectingly at places opposing the port 22 and the closed wall 23. A plurality of comb teeth 29 are provided projectingly between the side frames 28. Each comb tooth 27 of the first comb tooth group 11 and each comb tooth 29 of the second comb tooth group 12 extend in the same extending direction Y inclining with respect to the extending direction X of the insertion grooves 9 and 10. An extending direction Y27 of each comb tooth 27 and an extending direction Y29 of each comb tooth 29 extend in the opposing direction to each other on the extending direction Y.

Figure 3A:
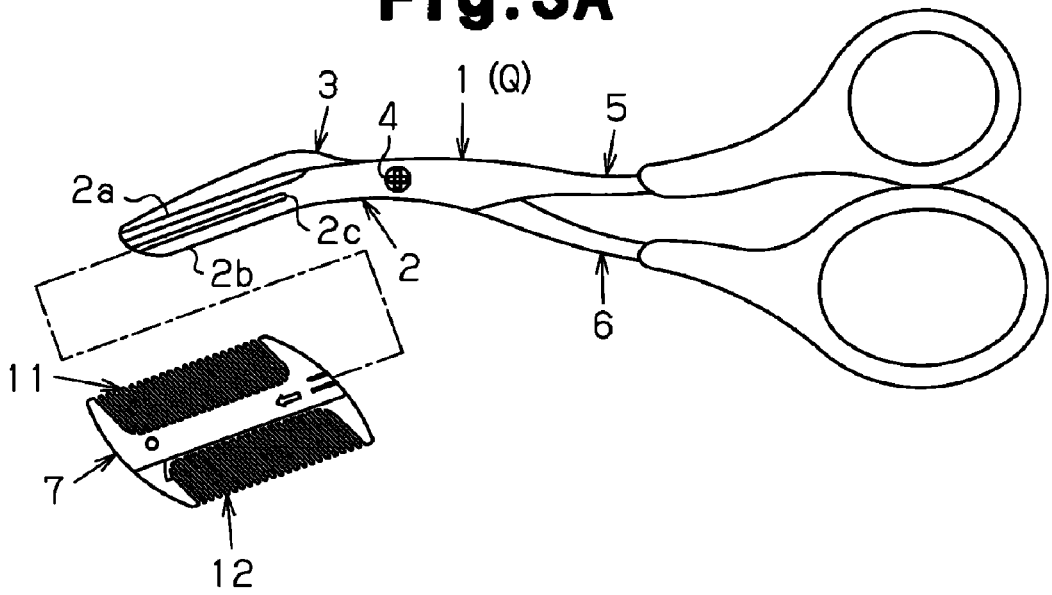
FIG. 3A is a front view showing a state where the scissors body in a closed state is detached from an insertion groove provided on a first comb tooth group of the comb member.
Figure 3B:
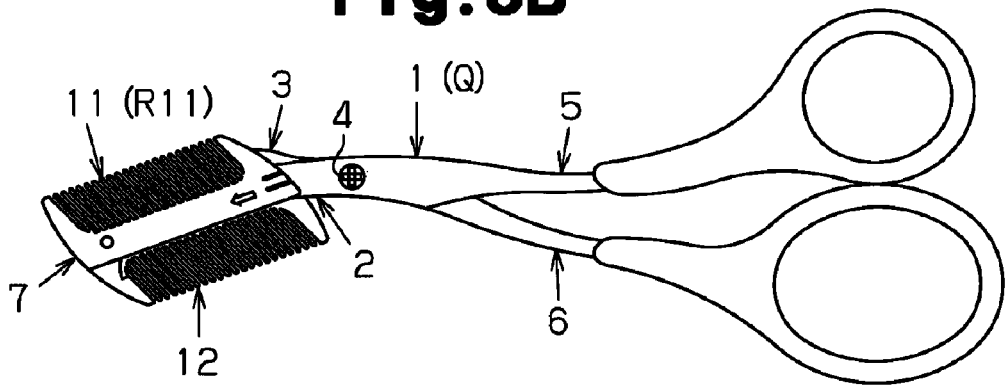
FIG. 3B is a front view showing a state where the scissors body in a closed state is attached to the insertion groove.
Figure 3C:
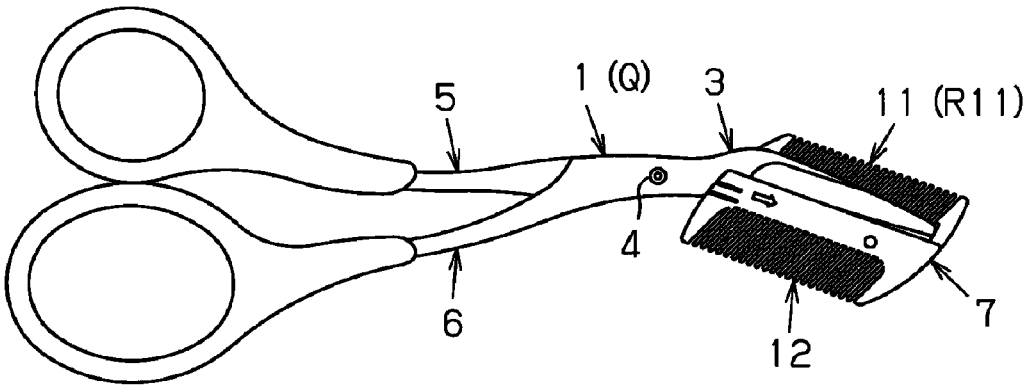
FIG. 3C is a back view showing the state where the scissors body in a closed state is attached to the insertion groove.

As shown in FIGS. 3B to 4B and 5A to 5B, the first blade 2 of the scissors body 1 is inserted from the port 17 into the first insertion groove 9 in a state where the comb member 7 is detached from the first blade 2 of the scissors body 1 as shown in FIG. 3A. At this time, the protrusion 24*a* of the engaging tongue 24 is engaged in the engaging groove 2*c* of the first blade 2. The first blade 2 abuts against the closed wall 18, thereupon constituting a mounting state R11. In the mounting state R11, the edge 2*a* of the first blade 2 projects from the opening 16 of the first insertion groove 9 and is aligned with each comb tooth 27 of the first comb tooth group 11. More specifically, the edge 2*a* of the first blade 2 extends along the first comb tooth group 11. In addition, the extending direction Y27 of each comb tooth 27 of the first comb tooth group 11 inclines with respect to the extending direction X of the edge 2*a* in the mounting state R11. More specifically, each comb tooth 27 inclines toward the closed wall 18 of the comb member 7. Whether the insertion of the first blade 2 has been completed can be determined by viewing, through the through-hole 25, the first blade 2 having been inserted into the first insertion groove 9.

Figure 6A:
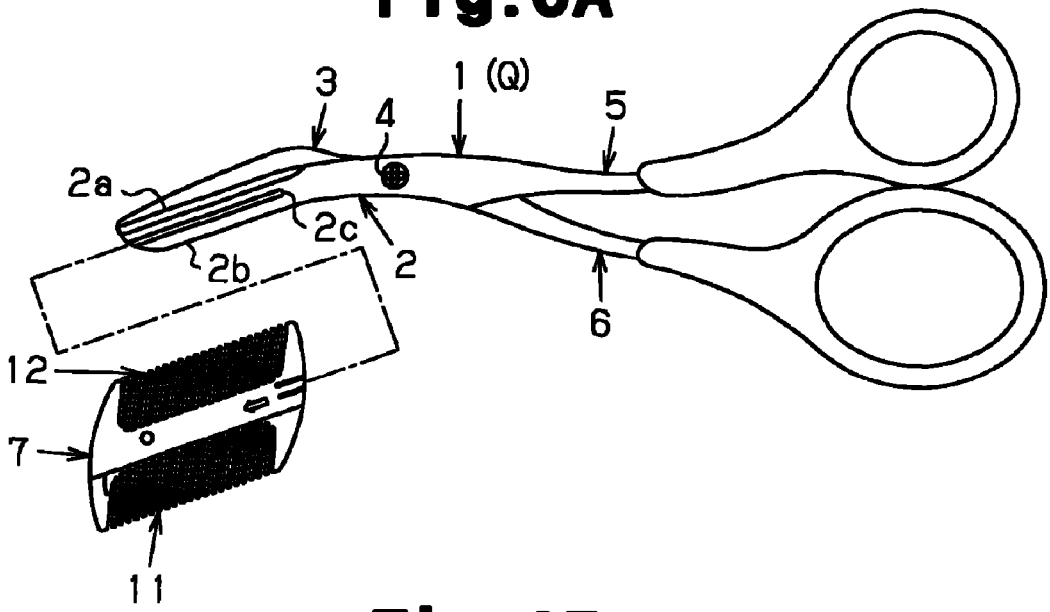
FIG. 6A is a front view showing a state where the scissors body in a closed state is detached from an insertion groove provided on a second comb tooth group of the comb member.
Figure 6B:
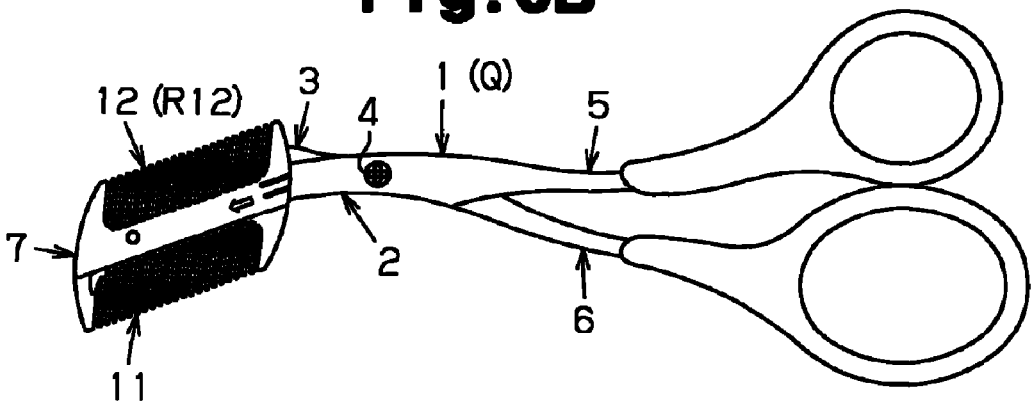
FIG. 6B is a front view showing a state where the scissors body in a closed state is attached to the insertion groove.
Figure 6C:
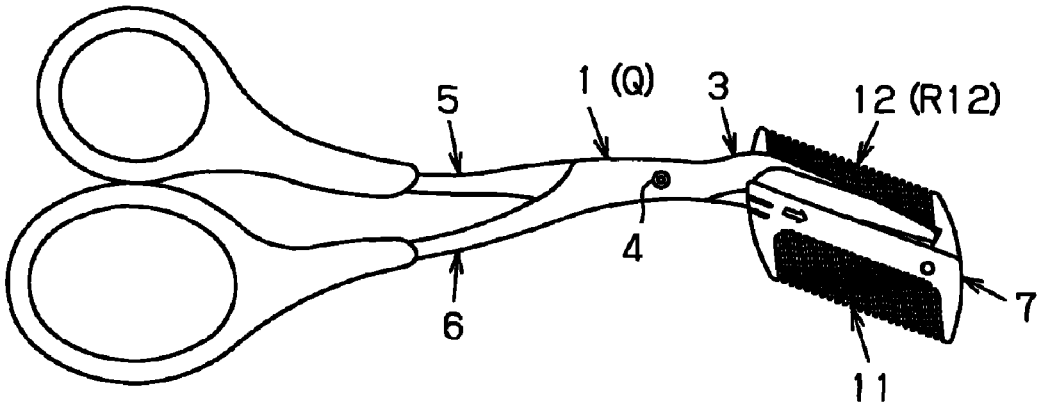
FIG. 6C is a back view showing the state where the scissors body in a closed state is attached to the insertion groove.

As shown in FIGS. 6B to 7B and 8A to 8B, the first blade 2 of the scissors body 1 is inserted from the port 22 into the second insertion groove 10 in a state where the comb member 7 is detached from the first blade 2 of the scissors body 1 as shown in FIG. 6A. At this time, the protrusion 24*a* of the engaging tongue 24 is engaged in the engaging groove 2*c* of the first blade 2. The first blade 2 abuts against the closed wall 23, thereupon constituting a mounting state R12. The edge 2*a* of the first blade 2 projects from the opening 21 of the second insertion groove 10 and is aligned with each comb tooth 29 of the second comb tooth group 12 in the mounting state R12. More specifically, the edge 2*a* of the first blade 2 extends along the second comb tooth group 12. Additionally, the extending direction Y29 of each comb tooth 29 of the second comb tooth group 12 inclines with respect to the extending direction X of the edge 2*a* in the mounting state R12. More specifically, each comb tooth 29 inclines toward the port 22 of the comb member 7. Whether the insertion of the first blade 2 has been completed can be determined by viewing, through the through-hole 25, the first blade 2 having been inserted into the second insertion groove 10.

Figure 5A:
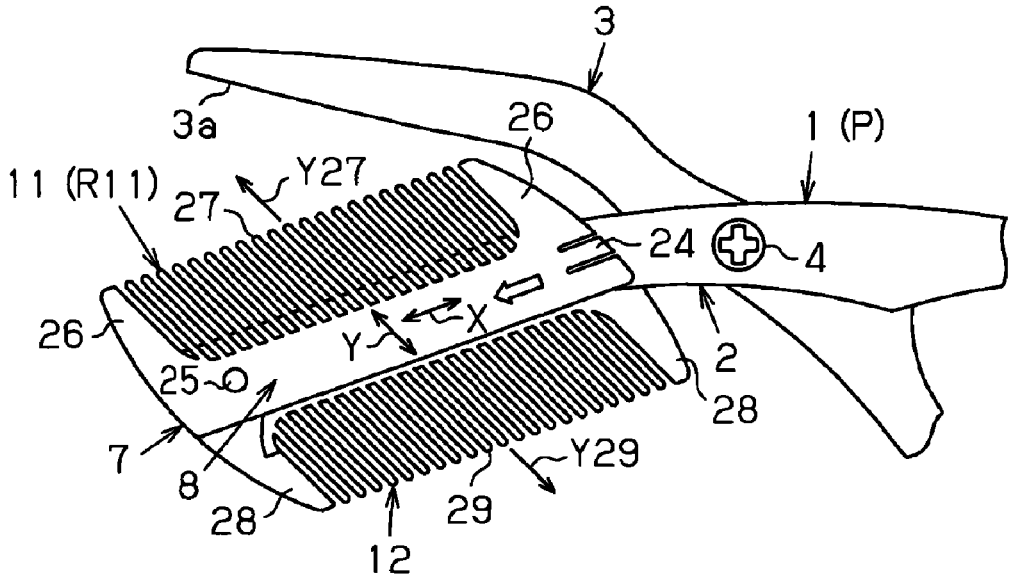
FIG. 5A is a front view showing, in an enlarged manner, a state where the scissors body shown in FIG. 3B is open.
Figure 5B:
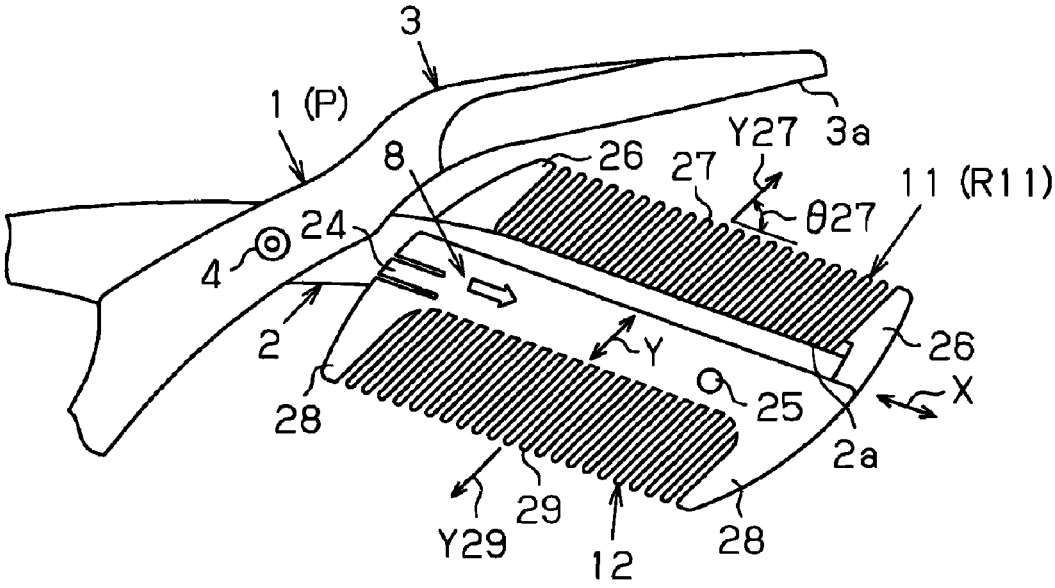
FIG. 5B is a back view showing, in an enlarged manner, a state where the scissors body shown in FIG. 3C is open.
Figure 8A:
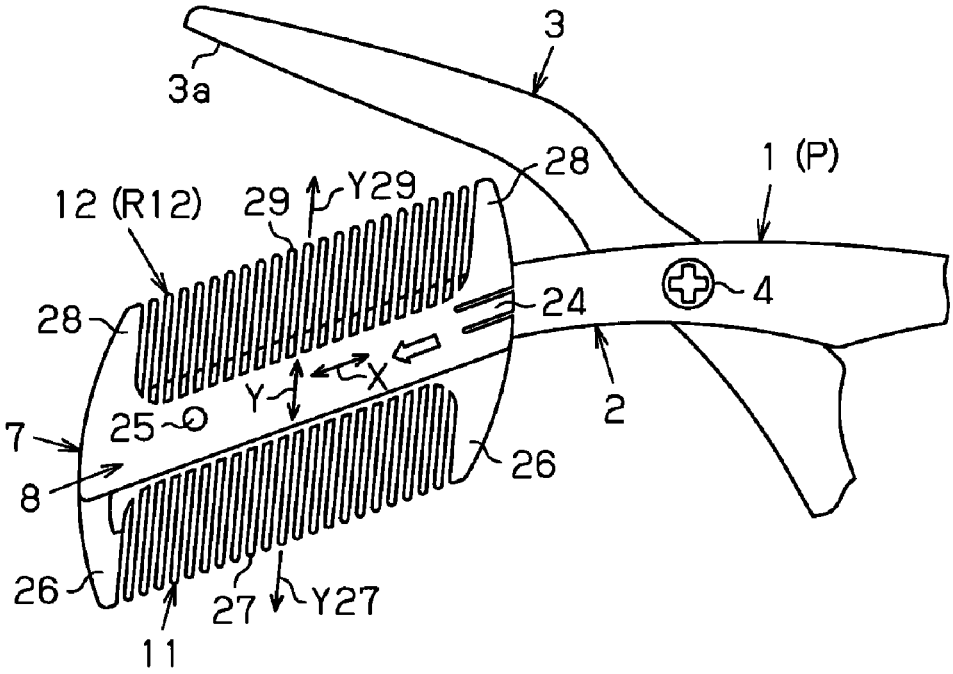
FIG. 8A is a front view showing, in an enlarged manner, a state where the scissors body shown in FIG. 6B is open.
Figure 8B:
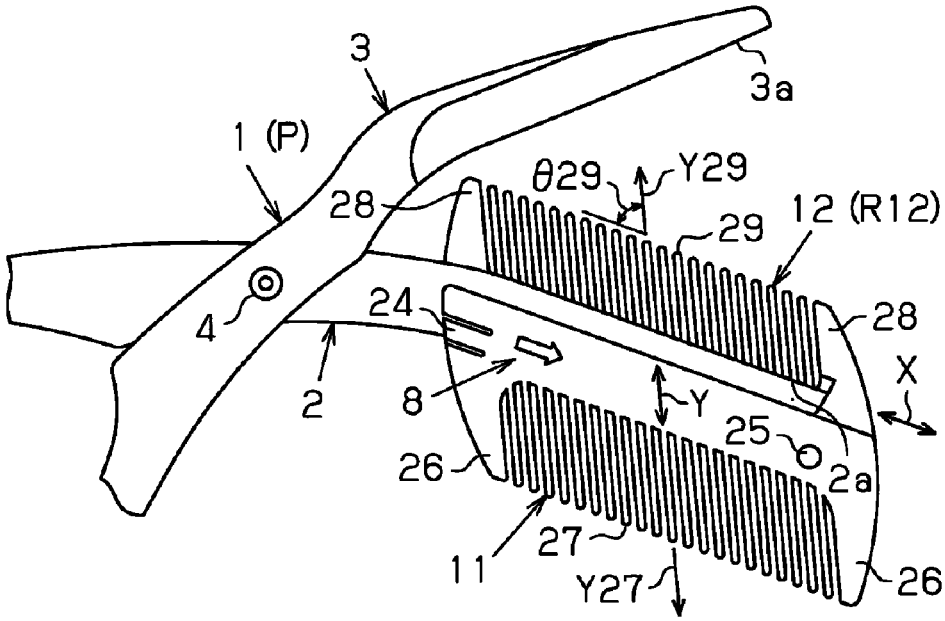
FIG. 8B is a back view showing, in an enlarged manner, a state where the scissors body shown in FIG. 6C is open.

As described above, the positions of the comb tooth groups 11, 12 with respect to the first blade 2, that is, comb tooth groups to be attached to the first blade 2 are changed, thereby being configured such that the extending direction Y27 of each comb tooth 27 in the mounting state R 11 and the extending direction Y29 of each comb tooth 29 in the mounting state R12 are different from each other. As shown in FIGS. 5B and 8B, an inclination angle θ27 of the extending direction Y27 of each comb tooth 27 with respect to the extending direction X of the edge 2*a* of the first blade 2 body and an inclination angle θ29 of the extending direction Y29 of each comb tooth 29 with respect to the extending direction X are set at 30 to 80 degrees respectively. The inclination angle θ27 is formed by the extending direction X and the extending direction Y27. The inclination angle θ27 is an angle opposing the closed wall 18 and the second blade 3. The inclination angle θ29 is formed by the extending direction X and the extending direction Y29 and is an angle opposing the port 22 and the second blade 3.

Figure 9A:
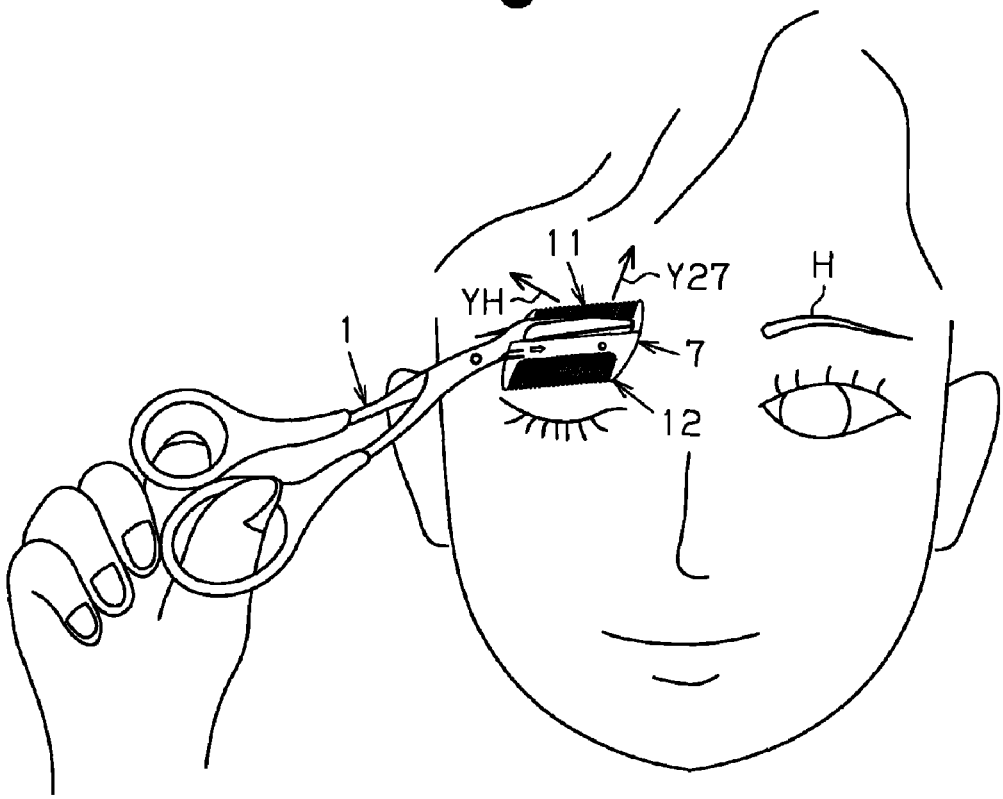
FIG. 9A is a diagram showing a state where a pair of scissors with comb is used.
Figure 10A:
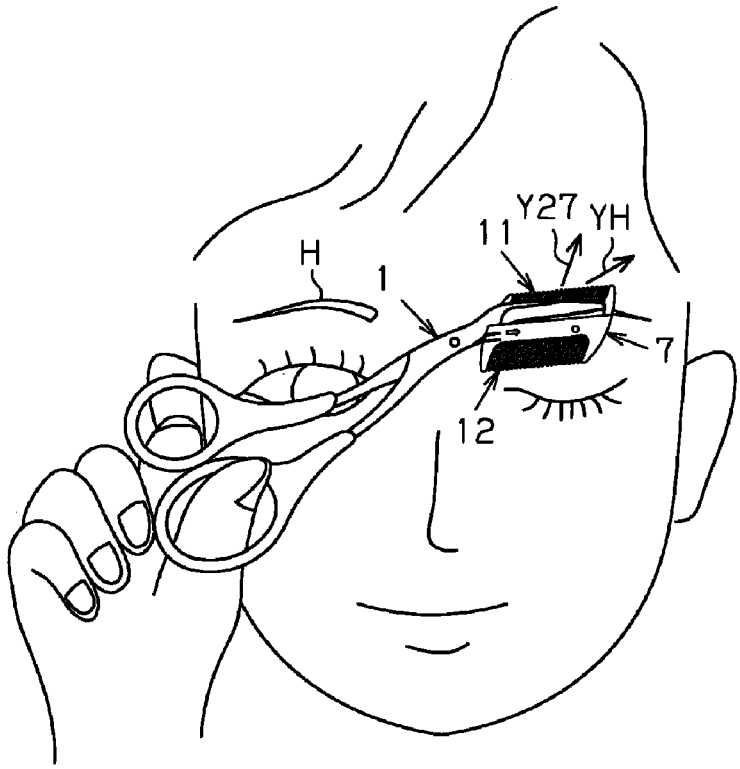
FIG. 10A is a diagram showing still another state where the pair of scissors with comb is used.

When a right eyebrow H is trimmed, the first blade 2 is inserted into the first insertion groove 9 corresponding to the first comb tooth group 11, whereupon the comb member 7 is attached to the first blade 2. As shown in FIGS. 3C, 4B, 5B and 9A, a front face of the first comb tooth group 11, for example, is placed on the right eyebrow H. Each comb tooth 27 is inserted from below the right eyebrow H in a scooping manner with the blades 2, 3 open. After that, the blades 2, 3 are opened and closed. At that time, the extending direction Y27 of each comb tooth 27 of the first comb tooth group 11 inclines leftward while a projecting direction YH of the right eyebrow H inclines rightward. Accordingly, each comb tooth 27 can be inserted from below the right eyebrow H in a scooping manner against the hair while a resistance is being caused, whereupon decumbent hair can be raised to be trimmed. Additionally, it is also possible that the front face of the first comb tooth group 11 in the state shown in FIG. 9A is placed on the left eyebrow H as shown in FIG. 10A and each comb tooth 27 is inserted from below the left eyebrow H in a scooping manner with the blades 2, 3 open, thereafter opening and closing the blades 2, 3. At that time, the extending direction Y27 of each comb tooth 27 of the first comb tooth group 11 inclines leftward while the projecting direction YH of the left eyebrow H also inclines leftward. Therefore, each comb tooth 27 can be inserted smoothly from below the left eyebrow H and along the left eyebrow H in a scooping manner. The left eyebrow H can be trimmed with the hair groomed.

Figure 9B:
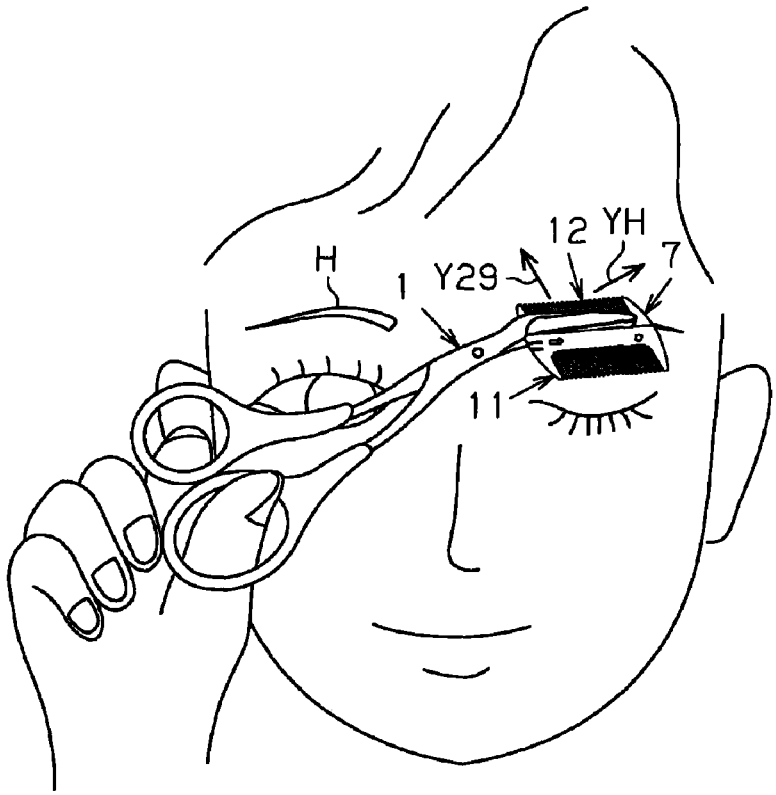
FIG. 9B is a diagram showing another state where the pair of scissors with comb is used.
Figure 10B:
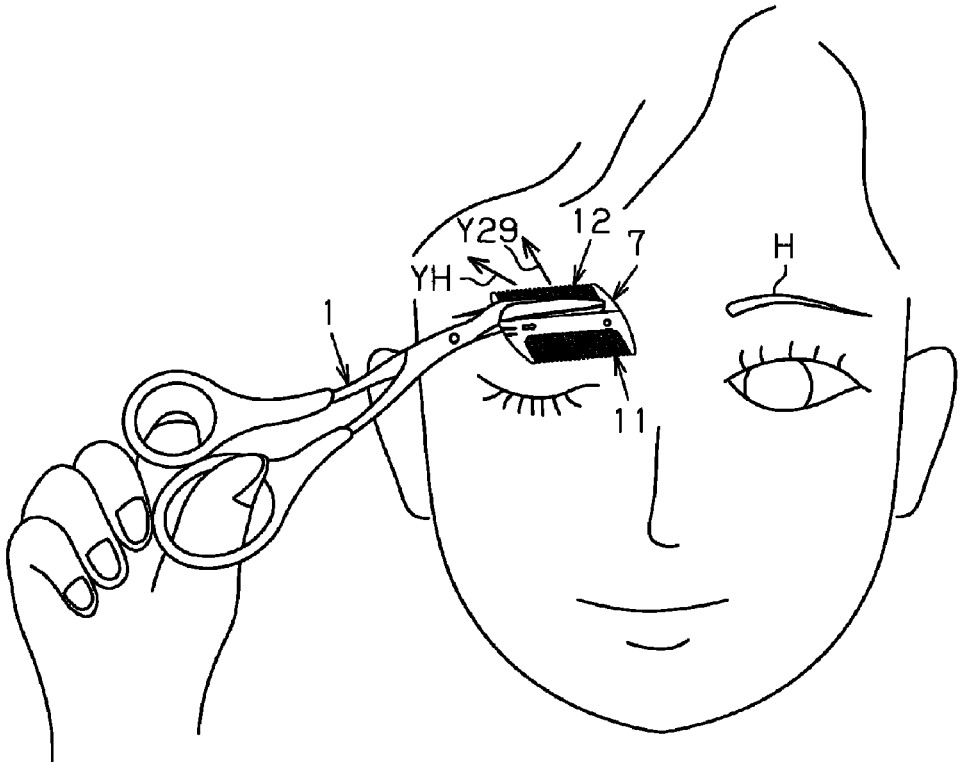
FIG. 10B is a diagram showing further another state where the pair of scissors with comb is used.

When the left eyebrow H is trimmed, the first blade 2 is inserted into the second insertion groove 10 corresponding to the second comb tooth group 12, whereupon the comb member 7 is attached to the first blade 2. As shown in FIGS. 6C, 7B, 8B and 9B, a front face of the second comb tooth group 12, for example, is placed on the left eyebrow H. Each comb tooth 29 is scoopingly inserted from below the left eyebrow H in a scooping manner with the blades 2, 3 open. After that, the blade 2, 3 are opened and closed. At that time, the extending direction Y29 of each comb tooth 29 of the second comb tooth group 12 inclines rightward while the projecting direction YH of the left eyebrow H inclines leftward. Therefore, each comb tooth 29 can be inserted from below the left eyebrow H in a scooping manner against the hair with a resistance caused, whereupon decumbent hair can be raised to be trimmed. Additionally, it is also possible that the front face of the second comb tooth group 12 in the state shown in FIG. 9B is placed to the right eyebrow H as shown in FIG. 10B and each comb tooth 29 is inserted from below the right eyebrow H in a scooping manner with the blades 2, 3 open, thereafter opening and closing the blades 2, 3. At that time, the extending direction Y29 of each comb tooth 29 of the second comb tooth group 12 inclines rightward while the projecting direction YH of the right eyebrow H also inclines rightward. Therefore, each comb tooth 29 can be inserted smoothly from below the right eyebrow H and along the right eyebrow H in a scooping manner. The right eyebrow H can be trimmed with the hair groomed.

Other than when the left eyebrow H and the right eyebrow H are trimmed in the above described manner, the pair of scissors with comb can be used for trimming other body hair such as head hair, and in particular, hair on temples. Furthermore, one of the comb tooth groups 11 and 12 which is other than the other aligned with the edge 2*a* of the first blade 2 can be used in combing the body hair.

The first embodiment has the advantages below.

A plurality of comb tooth groups 11, 12 with distinct characteristics from each other in the comb member 7 can be used properly in accordance with differences in characteristics such as the direction of eyebrows H and differences between the left eyebrow H hair and the right eyebrow H hair, for example. As a result, the scissors with comb can be rendered convenient.

The comb member 7 is attached to and detached from the first blade 2, whereupon the mounting states R11 and R12 of the comb tooth groups 11, 12 (the positions of the comb tooth groups 11, 12) are changed. Consequently, each comb tooth group 11, 12 can be used properly so that the extending direction Y of each comb tooth 27, 29 can be changed in accordance with differences in the direction of eyebrows H. As a result, the scissors with comb can be rendered convenient when the eyebrows H are trimmed.

Since the extending direction Y of the comb tooth 27, 29 in the comb tooth groups 11 and 12 of the comb member 7 is inclined, each comb tooth group 11, 12 can be used properly in accordance with differences in characteristics such as the direction of eyebrows H and differences between the left eyebrow H hair and the right eyebrow H hair, for example. Consequently, the scissors with comb can be rendered convenient.

In the comb member 7, the insertion grooves 9 and 10 are formed on each comb tooth group 11, 12 respectively. The edge 2*a* of the first blade 2 having been inserted and fixed to the insertion grooves 9, 10 projects from the latter, thereupon being aligned with the comb tooth groups 11, 12. The insertion grooves 9 and 10 are provided side by side in a circumferential direction about the extending direction of the first blade 2 (the inserting and removing direction of the first blade 2) X, and more specifically, the direction orthogonal to the extending direction X. The ports 17 and 22 of the insertion grooves 9, 10 are adjacent to each other at one of both sides in the extending direction X. Therefore, the mounting states R11 and R12 of the comb tooth groups 11, 12 can be changed easily in the comb member 7 with respect to the first blade 2. Moreover, a mounting structure of the comb-member 7 with respect to the first blade 2 can be simplified.

The extending direction Y27 of each comb tooth 27 with respect to the extending direction X in the mounting state R11 is different from the extending direction Y29 of each comb tooth 29 with respect to the extending direction X in the mounting state R12. Therefore, each comb tooth group 11, 12 can be used properly, for example, in accordance with differences in characteristics such as the direction of eyebrows H and differences between the left eyebrow H hair and the right eyebrow H hair, whereupon the usability of the scissors with comb can be improved.

The extending direction Y27 of each comb tooth 27 inclines toward the closed wall 18 of the comb member 7 in the mounting state R11. The extending direction Y29 of each comb tooth 29 inclines toward the port 22 of the comb member 7 in the mounting state R12. More specifically, the extending direction Y27 of each comb tooth 27 inclines toward one of both sides in the extending direction X in the mounting state R11. The extending direction Y29 of each comb tooth 29 inclines toward the other side in the extending direction X in the mounting state R12. As a result, each comb tooth group 11, 12 can be used properly, for example, according to differences in characteristics such as the direction of eyebrows H and differences between the left eyebrow H hair and the right eyebrow H hair, whereupon the scissors with comb can be rendered convenient.

In the comb member 7, the inclination angle θ27 of the extending direction Y27 of each comb tooth 27 in the first comb tooth group 11 with respect to the extending direction X of the edge 2*a* of the first blade 2 and the inclination angle θ29 of the extending direction Y29 of each comb tooth 29 in the second comb tooth group 12 with respect to the extending direction X are set at 30 to 80 degrees. Consequently, each comb tooth group 11, 12 can be used properly, for example, in accordance with differences in characteristics such as the direction of eyebrows H and differences between the left eyebrow H hair and the right eyebrow H hair so that the scissors with comb can be rendered convenient.

The extending direction Y of the first comb tooth group 11 and the extending direction Y of the second comb tooth group 12 extend in the opposing direction to each other in the comb member 7. Thus, each comb tooth group 11, 12 can be used properly, for example, according to differences in characteristics such as the direction of eyebrows H and differences between the left eyebrow H hair and the right eyebrow H hair, whereupon the usability can be improved of the scissors with comb.

The comb member 7 is molded integrally, whereby the comb member 7 can be molded without difficulty. Additionally, loss of a part of the comb member 7 can be avoided, and storage of the comb member 7 when not used can be facilitated.

The engaging groove 2*c* is formed on the outer surface of the first blade 2. The protrusion 24*a* is formed in each engaging tongue 24. The engaging groove 2*c* is formed only on the first blade 2 but not on the second blade 3. When the comb member 7 is attached to the first blade 2, the protrusion 24*a* of the engaging tongue 24 is inserted into the engaging groove 2*c* of the first blade 2. Since the engaging groove 2*c* is not formed on the second blade 3, the protrusion 24*a* prevents the second blade 3 from being inserted into each insertion groove 9, 10. Therefore, the comb member 7 is configured to be attachable only to the first blade 2 by the engaging groove 2*c* and the protrusion 24*a*. Therefore, a mistake in attachment of the comb member 7 to blades can be eliminated.

It should be apparent to those skilled in the art that the present invention may be embodied in many other specific forms without departing from the spirit or scope of the invention. Particularly, it should be understood that the invention may be embodied in the following forms.

In the comb tooth groups 11, 12 of the comb member 7, configurations of each comb tooth 27, 29 such as the thickness, the length, the cross-sectional shape and the interval may be changed. Flexibility and materials of each comb tooth 27, 29 may be changed. Each comb tooth 27, 29 may be surface-coated. That is, characteristics of the comb tooth groups 11 and 12 include not only the extending directions Y27 and Y29 of each comb tooth 27, 29 and the aforementioned configurations of each comb tooth 27, 29, but also the flexibility, materials and surface coating of each comb tooth 27, 29.

Figure 4E:
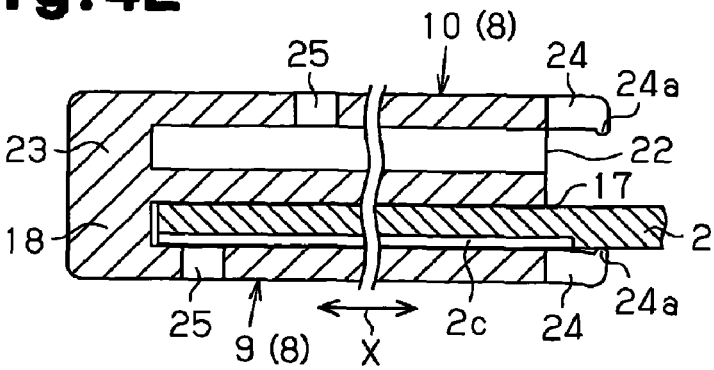
FIG. 4E is a cross-sectional view showing a state where a scissors body in a closed state is attached to an insertion groove in accordance with a modified embodiment.
Figure 7E:
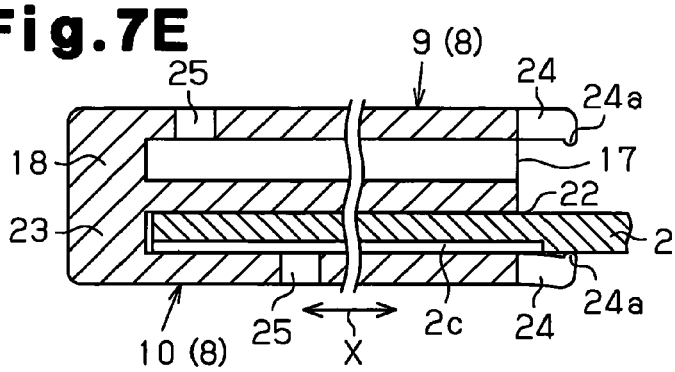
FIG. 7E is a cross-sectional view showing a state where a scissors body in a closed state is attached to an insertion groove in accordance with still a modified embodiment.

As shown in FIGS. 4E and 7E, the protrusion 24*a* of the engaging tongue 24 may be forced to contact the outer surface of the first blade 2 to prevent the comb member 7 from coming off when the first blade 2 of the scissors body 1 is inserted from the port 17, 22 to the first insertion groove 9 or the second insertion groove 10.

Three or more comb tooth groups may be arranged in the circumferential direction about the extending direction X, on the mounting portion group 8. One of the comb tooth groups and the edge of the first blade may be aligned.

Three or more comb tooth groups may be arranged radially on a plane passing the extending direction X, on the mounting portion group 8. One of the comb tooth groups may be aligned with the edge of the first blade.

The comb tooth groups 11, 12 may be provided side by side so as to extend along the extending direction X. One of the comb tooth groups may be aligned with the edge of the first blade.

In each comb tooth group 11, 12 of the comb member 7, the inclination angle θ27, θ29 of the extending direction of each comb tooth 27, 29 with respect to the extending direction of the edge 2*a* of the first blade 2, the length of each comb tooth 27, 29, the thickness of each comb tooth 27, 29 and the intervals of each comb tooth 27, 29 may be varied along the extending direction of the edge 2*a*.

The inner shape of each insertion groove 9, 10 may be changed such that the central plane Z between the inner and outer surfaces joining the edge 2*a* and back 2*b* of the first blade 2 inclines toward the direction away from each comb tooth 27, 29 in each insertion groove 9, 10. In this case, it becomes difficult for each comb tooth 27, 29 to contact the edge 2*a* of the first blade 2 and the second blade 3 even if bent.

A plurality of comb tooth groups 11, 12 may be pivotably or slidably supported with respect to one mounting portion provided in the comb member 7. Then, positions of the comb tooth groups 11, 12 with respect to the first blade 2 may be configured to be changeable.

One comb tooth group may be tiltably supported with respect to one mounting portion provided in the comb member 7. The inclination angle of each comb tooth with respect to the extending direction of the edge 2*a* of the first blade 2 may be configured changeably.

A plurality of comb tooth groups with the same characteristics may be provided in the comb member 7. One of the comb tooth groups may be used and then the others may be used in reserve.

In each comb tooth group 11, 12 of the comb member 7, the interval of the side frames 26, 28 is set at approximately 23 mm and the length of each comb tooth 27, 29 is set at approximately 9 mm. The values may be changed according to intended purposes.

Other than the insertion grooves 9 and 10, the mounting portion of the comb member 7 to the first blade 2 may be a magnet detachably attached to the first blade 2, a hook and loop fastener detachably coupled to another hook and loop fastener provided in the first blade 2, a female or male thread detachably engaged with the first blade 2, an engaging shaft or engaging hole detachably inserted into the first blade 2 or a clipping portion detachably holding the first blade 2.

The comb member may be composed of a plurality of sets of a comb tooth group and a mounting portion and be broken at a breakable portion into each set of the comb tooth group and the mounting portion to be separated from the comb member. Each separated set may be used independently.

The comb member may be composed of a plurality of sets of a comb tooth group and a mounting portion and be separated from each other for every set of the comb tooth group and the mounting portion to be molded. Each set may be used independently or used as detachably coupled to each other at a coupling portion.

The scissors body 1 for a right-handed person and the corresponding comb member 7 are exemplified in the first embodiment. However, the scissors body 1 may be changed to one for a left-handed person and then the mounting portion and comb tooth groups of the comb member, to left-handed ones. A form of a mirror image of the right-handed scissors with comb may be adopted as a pair of scissors with comb for a left-handed person, for example.

Figure 11:
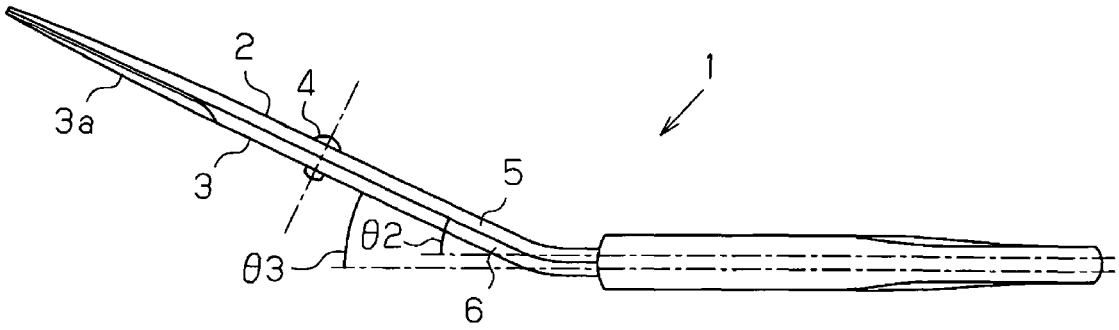
FIG. 11 is a side view showing a scissors body in accordance with another modified embodiment.

In order that the first blade 2 and the second blade 3 incline with respect to a plane passing the handles 5 and 6, the scissors body 1 may be bent at a side closer to the proximal end than the opening/closing pivot 4 thereof, as shown in FIG. 11. An inclination angle θ2 of the first blade 2 with respect to the plane passing the handle 5 preferably exceed zero degrees and no more than 35 degrees, and more preferably 20 to 35 degrees. An inclination angle θ3 of the second blade 3 with respect to the plane passing the handle 6 is also set in a similar range of the inclination angle θ2. The inclination angle θ2 of the first blade 2 with respect to the plane passing the handle 5 and the inclination angle θ3 of the second blade 3 with respect to the plane passing the handle 6 shown in FIG. 11 are 25 degrees respectively. Also in this configuration, the first blade 2 is inserted into the first insertion groove 9 corresponding to the first comb tooth group 11, for example. According to the configuration, when the left eyebrow H is trimmed, each handle 5, 6 can be spaced apart from a face easily as compared with the first embodiment, whereupon the scissors with comb can be used with ease. When the inclination angles θ2, θ3 are less than 20 degrees, there is possibility that each handle 5, 6 comes close to the face in using the scissors with comb. When the inclination angles θ2, θ3 exceed 35 degrees, each blade 2, 3 is excessively bent so that gripping each handle 5, 6 for example, when each comb tooth 29 is inserted into the left eyebrow H in a scooping manner becomes difficult. As a result, opening and closing of the blades 2, 3 in a state where each comb tooth 29 is inserted in the left eyebrow H in a scooping manner becomes difficult.

Therefore, the present examples and embodiments are to be considered as illustrative and not restrictive and the invention is not to be limited to the details specific herein, but may be modified within the scope and equivalence of the appended claims.

What is claimed is:

1. A pair of scissors with a comb comprising:

a first blade having an edge;

a second blade openably and closably supported together with the first blade and having an edge;

a comb member detachably attached to the first blade and having a plurality of comb tooth groups; and a mounting portion provided in the comb member, mounting the comb member to the first blade, wherein the positions of the comb tooth groups with respect to the first blade are changeable, wherein the comb tooth groups include a first comb tooth group and a second comb tooth group that extend from the mounting portion in an opposing direction to each other, wherein each comb tooth of the first comb tooth group and each comb tooth of the second comb tooth group extend to incline with respect to an extending direction of the mounting portion, and wherein there is a difference between an extending direction of comb teeth of the first comb tooth group with respect to an extending direction of the edge of the first blade in a state where the comb member is attached to the first blade and the first comb tooth group and the edge of the first blade are aligned with each other, and an extending direction of comb teeth of the second comb tooth group with respect to the extending direction of the edge of the first blade in a state where the comb member is attached to the first blade and the second comb tooth group and the edge of the first blade are aligned with each other.

2. The pair of scissors with a comb according to claim 1, wherein the mounting portion has insertion grooves provided in the comb member for each comb tooth group respectively, each insertion groove has an inserting and removing port into which the first blade is detachably inserted, wherein the edge of the first blade inserted in and fixed to an insertion groove corresponding to the specific comb tooth group projects from the insertion groove, and the edge of the first blade and the specific comb tooth group are aligned.

3. The pair of scissors with a comb according to claim 2, wherein the insertion grooves are arranged side by side in a circumferential direction about an inserting and removing direction of the first blade with respect to the insertion grooves, and wherein the ports of the insertion grooves are adjacent to each other at one of both sides of the insertion grooves in the inserting and removing direction.

4. The pair of scissors with a comb according to claim 3, wherein the insertion grooves comprise a first insertion groove corresponding to the first comb tooth group and a second insertion groove corresponding to the second comb tooth group, and wherein an extending direction of a comb tooth of the first comb tooth group inclines with respect to an extending direction of the edge of the first blade in a state where the first blade is inserted in and fixed to the first insertion groove, and an extending direction of a comb tooth of the second comb tooth group inclines with respect to the extending direction of the edge of the first blade in a state where the first blade is inserted in and fixed to the second insertion groove.

5. The pair of scissors with a comb according to claim 4, wherein the extending direction of the comb tooth of the first comb tooth group inclines toward one of both sides of the comb member in the extending direction of the edge of the first blade, and the extending direction of the comb tooth of the second comb tooth group inclines toward the other side of the comb member in the extending direction of the edge of the first blade.

6. The pair of scissors with a comb according to claim 5, wherein the inclination angle of the extending direction of the comb tooth of the first comb tooth group with respect to the extending direction of the edge of the first blade and the inclination angle of the extending direction of the comb tooth of the second comb tooth group with respect to the extending direction of the edge of the first blade are each set at 30 to 80 degrees.

7. The pair of scissors with a comb according to claim 4, wherein the extending direction of the first comb tooth group and the extending direction of the second comb tooth group extend in opposite directions.

8. The pair of scissors with a comb according to claim 1, further comprising handles each extending from one of the blades, wherein the blades incline with respect to a plane passing the handles.

* * * * *